US008347895B2

(12) United States Patent
Campbell Rose

(10) Patent No.: US 8,347,895 B2
(45) Date of Patent: Jan. 8, 2013

(54) MASSAGE COMB

(76) Inventor: Andriette Campbell Rose, Wesley Chapel, FL (US)

( * ) Notice: Subject to any disclaimer, the term of this patent is extended or adjusted under 35 U.S.C. 154(b) by 0 days.

(21) Appl. No.: 13/134,837

(22) Filed: Jun. 20, 2011

(65) Prior Publication Data

US 2012/0118311 A1 May 17, 2012

(51) Int. Cl.
*A45D 24/22* (2006.01)
*A45D 24/00* (2006.01)
*A45D 24/16* (2006.01)

(52) U.S. Cl. ..... 132/114; 132/219; 132/111; 132/112

(58) Field of Classification Search ..... 132/111, 132/202, 207, 212, 213.1, 219, 107, 108, 132/112–114, 121, 123, 148, 149, 152, 159, 132/160, 221, 901, 115, 150, 155, 120; 401/28, 401/138, 126, 127, 137, 140, 196, 265; 119/602, 119/603, 613, 614, 616, 622, 625, 664; 222/191, 222/522; D28/21
See application file for complete search history.

(56) References Cited

U.S. PATENT DOCUMENTS

| | | | | | |
|---|---|---|---|---|---|
| 727,312 | A * | 5/1903 | Douglas | 132/112 |
| 2,036,354 | A * | 4/1936 | Nishio | 15/159.1 |
| 2,128,183 | A * | 8/1938 | Hickey | 132/111 |
| 2,139,904 | A * | 12/1938 | Merrill | 132/114 |
| 2,160,618 | A * | 5/1939 | Kreutzig | 132/120 |
| 2,303,643 | A * | 12/1942 | Illingworth | 132/119 |
| 2,336,717 | A * | 12/1943 | Crimmins | 401/22 |
| 2,381,048 | A * | 8/1945 | Habostad | 132/113 |
| 2,497,983 | A * | 2/1950 | Fabis | 132/147 |
| 2,532,505 | A * | 12/1950 | Love | 132/120 |
| 2,571,226 | A * | 10/1951 | Fabis | 220/212 |
| 2,694,401 | A * | 11/1954 | Francis | 132/116 |
| 2,725,886 | A * | 12/1955 | Gagliano | 132/148 |
| 2,849,009 | A * | 8/1958 | Heinrich et al. | 132/116 |
| 2,854,987 | A * | 10/1958 | Anthony | 132/150 |
| 3,463,170 | A * | 8/1969 | McCullough | 132/113 |
| 4,013,086 | A * | 3/1977 | Chmela | 132/110 |
| 4,090,522 | A * | 5/1978 | Donley et al. | 132/112 |
| 4,213,473 | A * | 7/1980 | Dawson | 132/113 |
| 4,317,464 | A * | 3/1982 | Bailey et al. | 132/113 |
| 4,543,913 | A * | 10/1985 | Wilkeson | 119/603 |
| 4,913,172 | A * | 4/1990 | Chou | 132/118 |
| 5,325,878 | A * | 7/1994 | McKay | 132/116 |
| 5,339,839 | A * | 8/1994 | Forcelledo et al. | 132/114 |
| 5,482,058 | A * | 1/1996 | Garconnet | 132/116 |
| 5,803,093 | A * | 9/1998 | Romano | 132/116 |
| 6,047,703 | A * | 4/2000 | Paglericcio et al. | 132/113 |
| 6,260,557 | B1 * | 7/2001 | Yarbrough | 132/208 |
| 6,378,529 | B1 * | 4/2002 | Clemente Marco | 132/111 |
| 6,539,949 | B2 * | 4/2003 | Christensen | 132/114 |
| 8,220,469 | B1 * | 7/2012 | Spagnuolo | 132/114 |
| 2008/0127989 | A1 * | 6/2008 | Chapman et al. | 132/118 |
| 2008/0210251 | A1 * | 9/2008 | Dallianis et al. | 132/116 |
| 2009/0126752 | A1 * | 5/2009 | Emerson | 132/200 |

* cited by examiner

*Primary Examiner* — Vanitha Elgart
(74) *Attorney, Agent, or Firm* — Werner Schroeder

(57) ABSTRACT

A massage comb is disclosed for applying ointments directly to the scalp of a person. The comb consists of an upper and a lower section with the lower section having hollow teeth with openings at the bottom of each of the teeth. The comb may be constructed of bamboo so that the ointment may penetrate through the bamboo material and apply the ointment to the strands of the hair. The upper and lower section are fastened to each other by way of dove tail system to allow easy access for the ointment to be filled into the lower section.

1 Claim, 3 Drawing Sheets

MASSAGE COMB

BACKGROUND OF THE INVENTION

The inventive concept of a massage comb involves a two part comb combination with an upper part which can be slidably removed to gain excess to a lower part which contains the teeth which are hollow in a lengthwise direction to receive a lotion that can be applied to the skin of the head during the massaging action. The wood of the massage comb is made of bamboo which is low in formaldehyde which allows any fluid to permeate through the wood to thereby transfer some of the fluid to the hair strands during the combing action.

U.S. Pat. No. 3,295,537 illustrates a comb having hollow teeth to permit a fluid to pass there through. However, The discharge of the fluid is accomplished on a lateral side of the teeth so that the fluid is discharged onto the hair but not directly to the skin on the head which is an object of this invention.

U.S. Pat. No. 4,013,086 discloses a comb that will transfer a fluid to the hair while combing. The discharge of the fluid is accomplished by inserts of absorbent material which is placed along the longitudinal axis of the teeth to transfer the liquid from the inside of the teeth to the outside and thereby to the hair. No fluid is directly transferred to the skin of the head during a combing action which again is an object of this invention.

BRIEF DESCRIPTION OF THE INVENTION

The method of applying treatment oils directly to the scalp involves the use of a two part comb combination, preferably made of bamboo. The treatment oil is disposed through the hollow comb's teeth that have an aperture through the teeth in the longitudinal direction. The aperture ends or is open at the tip of the teeth. The fact that the comb assembly is made of bamboo aids in the application of the treatment oils directly to the hair strands because bamboo allows the oils to permeate through the material.

BRIEF DESCRIPTION OF THE DRAWINGS

FIG. 3 is a side view of a single tooth showing an aperture there through;

FIGS. 4A and 4B show two side views of the assembled comb.

DETAILED DESCRIPTION OF THE INVENTION

Figure 1A:
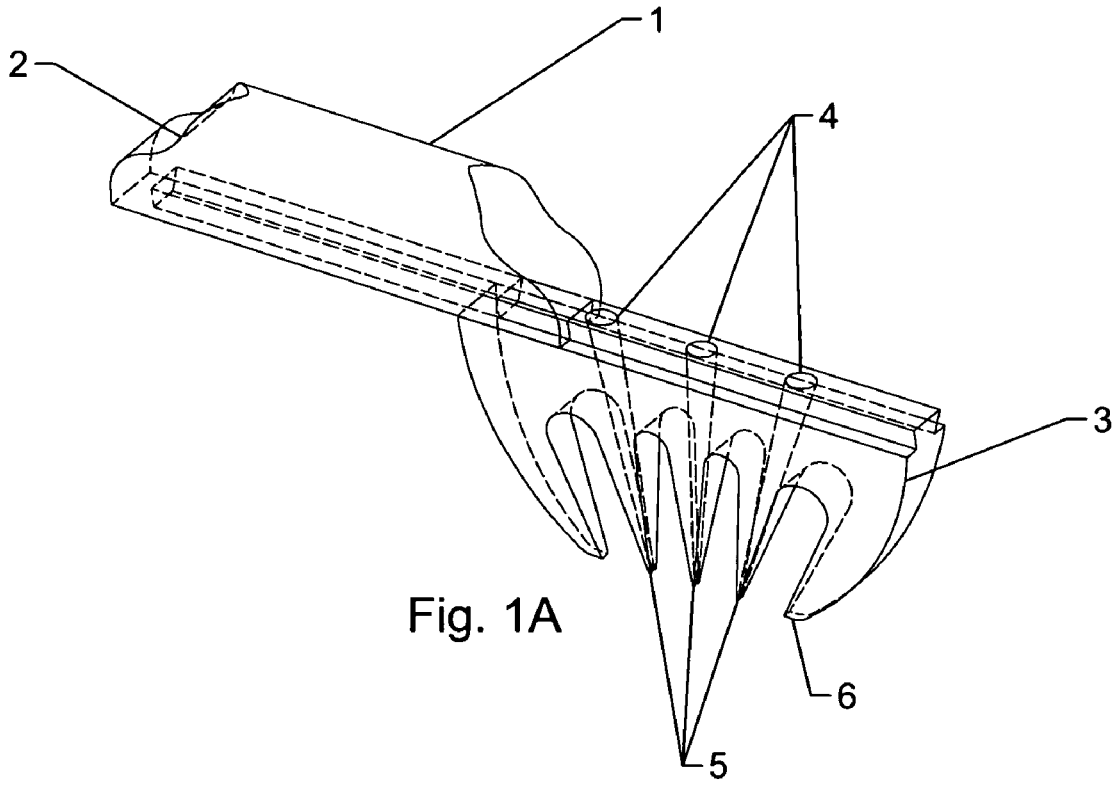
FIG. 1A is a perspective view of the massage comb in an opened state.
Figure 1:
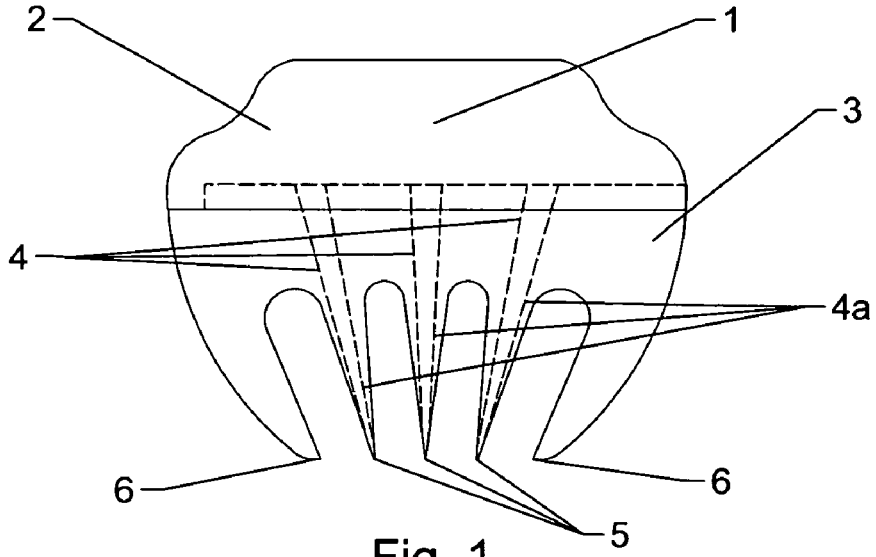
FIG. 1 is a front view of the fully assembled massage comb.

In FIG. 1, 1 is the fully assembled massage comb, wherein 2 is the upper section of the comb which can slidably be removed from the lower section 3. The lower removable section 3 shows at least three teeth 4 having elongated apertures 4*a* there through which have an opening 5 at each end thereof. The outer teeth 6 are blank and are useful in combing through the hair strands.

Figure 2:
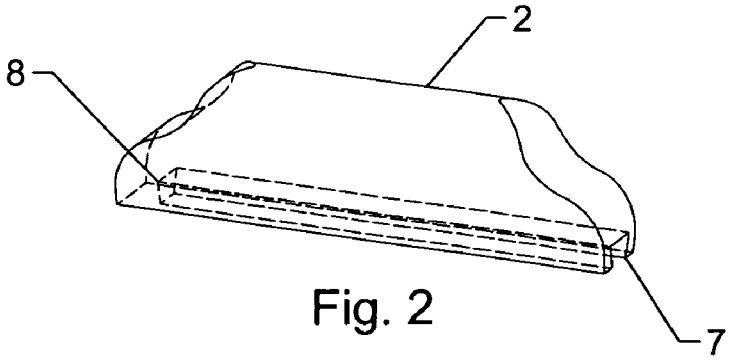
FIG. 2 is a side view of the upper section of the massage comb.
Figure 2A:
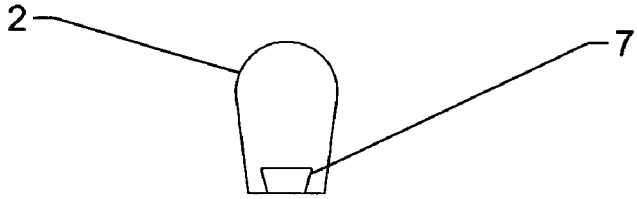
FIG. 2A is a perspective view of the upper section.

FIG. 2 shows the upper section 2 which has at the bottom thereof a female dove tail 7. The female dove tail 7 ends at 8. This end 8 is shown in FIG. 2A. The reason for this end 8 is to gain stability of the overall combination 1 when the lower section 2 is slid into the dove tail groove 7 so that no particular attention needs to be provided when the two sections 2 and 3 are combined. This represents an automatic sliding stop.

Figure 3A:
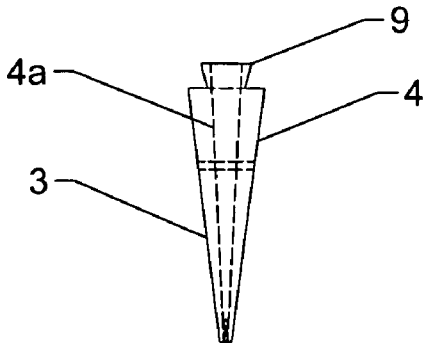
FIG. 3A is an upper view of the lower section.
Figure 3:
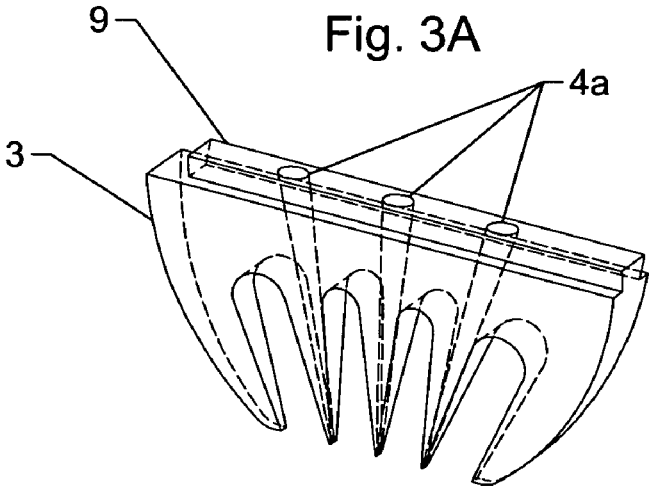

FIG. 3 shows a side view of the lower section 3 including the through aperture 4*a*. At the upper end there is shown the male part of the dove tail 9 which will slide into the female dove tail 7 as was explained above.

FIG. 3A is a perspective side view of a portion of the lower section 3 including the male dove tail 9. The jagged line indicates only a portion of the upper section.

Figure 4:
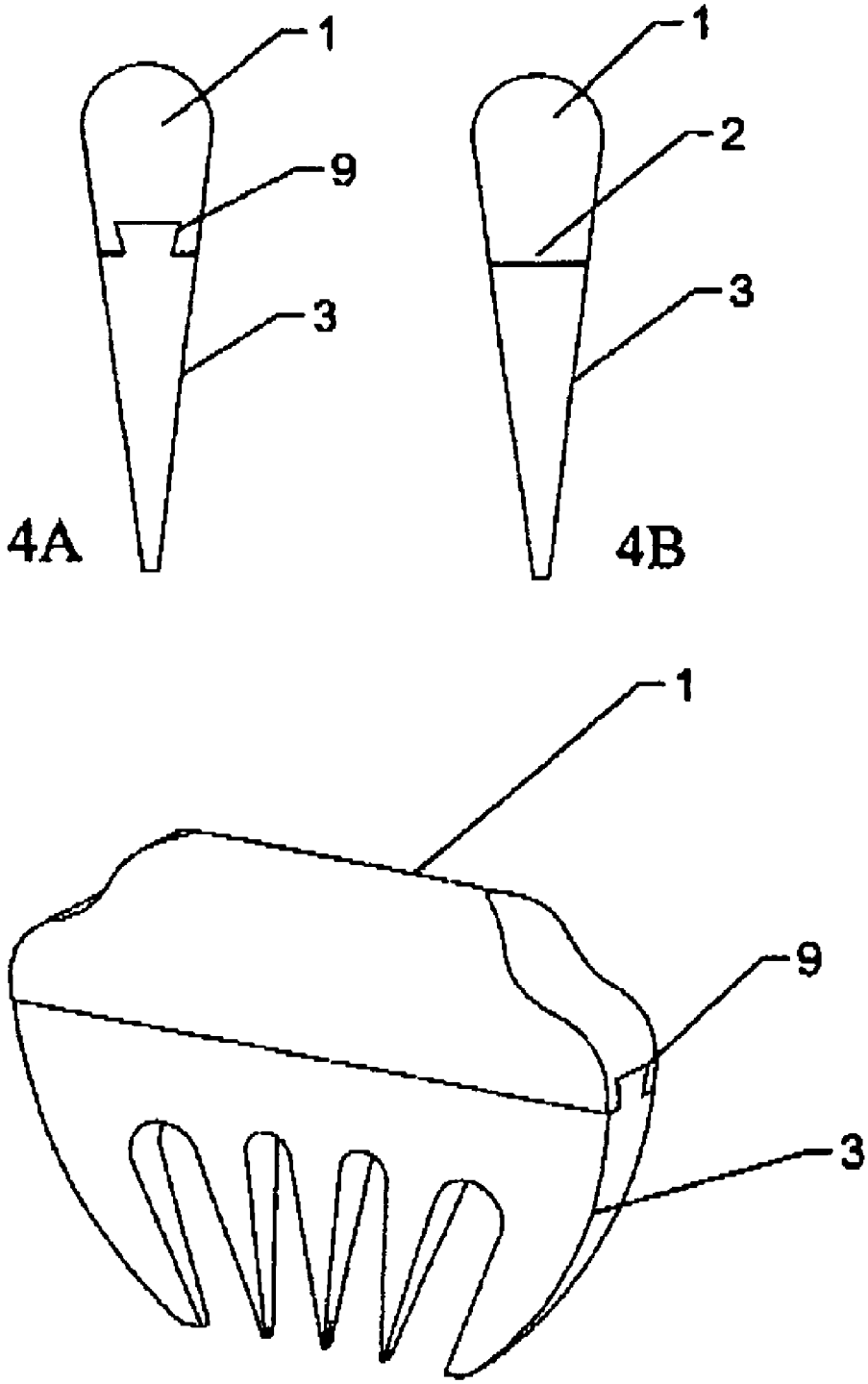
FIG. 4 shows a perspective view of the assembled comb.

FIG. 4 is a perspective view if the assembled comb. The upper portion is shown at 2 and the lower portion is shown at 3. Also the dove tails system can be seen at 9.

FIG. 4A is a side view of the massage comb assembly including the dovetail system 9 including the dove tail system 9.

FIG. 4B shows the a side view of the massage comb 1 where the dove tail system has been eliminated instead the upper section 2 and the lower section are fastened to each other by way of flat surface and could be fastened to each other by gluing.

The drawings make it clear that the opening in each of the bottoms of the teeth ensure that the ointment is only applied to the scalp of the person being treated. To assure a good flow of the ointment the openings in the bottom of the teeth are unobstructed.

What I claim is:

1. A massage comb and fluid application combination for use on a scalp of a user including an upper section and a lower removable section, said lower section has several teeth depending therefrom, said lower section having a treatment fluid contained therein, said lower section is being made of a bamboo material which will allow said treatment fluid to permeate through said material and transfer said treatment fluid to strands of hair, wherein said upper and lower sections are held together by way of a dove tail arrangement and wherein each of said teeth of said lower section has a through aperture therein and a tip with an opening to apply said treatment fluid to a scalp of a user.

* * * * *